US012377890B2

(12) United States Patent
Lahrs et al.

(10) Patent No.: US 12,377,890 B2
(45) Date of Patent: Aug. 5, 2025

(54) SAFETY BARRIER BETWEEN COUPLED CARS OF A TRANSPORTATION VEHICLE

(71) Applicant: NIAGARA FRONTIER TRANSPORTATION AUTHORITY, Buffalo, NY (US)

(72) Inventors: Eric J. Lahrs, Orchard Park, NY (US); Shawn E. Sikes, Buffalo, NY (US)

(73) Assignee: Niagara Frontier Transportation Authority, Buffalo, NY (US)

( * ) Notice: Subject to any disclaimer, the term of this patent is extended or adjusted under 35 U.S.C. 154(b) by 771 days.

(21) Appl. No.: 17/716,835

(22) Filed: Apr. 8, 2022

(65) Prior Publication Data

US 2023/0322278 A1 Oct. 12, 2023

(51) Int. Cl.
*B61G 11/18* (2006.01)

(52) U.S. Cl.
CPC ..... *B61G 11/18* (2013.01)

(58) Field of Classification Search
CPC ..... B61G 11/18; B65G 43/00; B66B 29/04
See application file for complete search history.

(56) References Cited

U.S. PATENT DOCUMENTS 4,241,665 A 12/1980 Kleim
4,781,123 A 11/1988 Yoshihara
6,595,344 B1 * 7/2003 Davis ..... B66B 29/04 198/326
6,694,890 B2 2/2004 Kennedy

* cited by examiner

*Primary Examiner* — Robert J McCarry, Jr.
(74) *Attorney, Agent, or Firm* — Hodgson Russ LLP; David J. State, Esq.

(57) ABSTRACT

An apparatus for providing a barrier between a first rail car and a second rail car connected to the first rail car by a coupling includes a support assembly and a brush member. The support assembly includes a holding member, and is configured to be mounted on the first rail car. The brush member has a spine and a plurality of bristles extending from the spine. The spine of the brush member is received by the holding member of the support assembly such that the plurality of bristles occupy space above the coupling when the support assembly is mounted on the first rail car, thereby forming the barrier.

13 Claims, 8 Drawing Sheets

SAFETY BARRIER BETWEEN COUPLED CARS OF A TRANSPORTATION VEHICLE

FIELD OF THE DISCLOSURE

The present disclosure relates to safety apparatus for discouraging persons from passing between coupled cars of a transportation vehicle, for example coupled rail cars of a train.

BACKGROUND OF THE DISCLOSURE

Public transportation vehicles, such as light rail systems, trains, subways, and trolleys, commonly comprise multiple cars joined end-to-end by couplings which allow adjacent cars to pivot relative to one another as the vehicle travels along a curved path. When multiple cars are employed, passengers and other persons have been known to pass between coupled cars while the vehicle is stopped to get from one side of the vehicle to the other side of the vehicle, for example as a short cut to reach a boarding platform or another destination. Typically, the coupling between two cars is low and can be stepped on and over. Despite warning signs posted on the vehicle near such couplings, people behave in a risky manner by passing between coupled cars. Even if the vehicle is stationary, people trip and fall crossing a coupling and sustain injuries. Occasionally, the vehicle resumes motion while a person is passing between cars, resulting in serious injury or death.

Efforts to provide a barrier between coupled cars of a vehicle to dissuade dangerous crossings have been made. Drawbacks of prior art barrier systems known to applicant include mechanical complexity, high cost to manufacture and maintain, difficulty in mounting the barrier system on cars of a vehicle, failure of the barrier system in freezing temperatures and/or inclement weather, and risk of a person becoming entangled in the barrier system (e.g., clothing caught on a portion of the barrier system) or otherwise trapped by the barrier system between coupled cars.

An improved between-car barrier system addressing these drawbacks is needed to enhance public safety.

SUMMARY OF THE DISCLOSURE

An embodiment of the present disclosure provides an apparatus for providing a barrier between a first rail car and a second rail car connected to the first rail car by a coupling. The apparatus may comprise a support assembly configured to be mounted on the first rail car, the support assembly including a holding member, and a brush member having a spine and a plurality of bristles extending from the spine. The spine of the brush member may be received by the holding member of the support assembly such that the plurality of bristles occupy space above the coupling when the support assembly is mounted on the first rail car.

According to an embodiment of the present disclosure, the holding member may include a channel, and the spine may be slideably received by the channel.

According to an embodiment of the present disclosure, the apparatus may further comprise a retainer pin. The holding member and the spine may include respective holes aligned with one another when the spine is received by the holding member, and the retainer pin may be slidably insertable into the aligned holes to releasably retain the spine in the channel of the holding member.

According to an embodiment of the present disclosure, the support assembly may further include a threaded rod to which the holding member is coupled, a mounting plate having an opening through which the threaded rod extends through the mounting plate, and a positioning nut mated with the threaded rod and fixed relative to the holding member. The support assembly may be mountable on an anti-climber extension of the first rail car by setting the mounting plate on the anti-climber extension, extending the threaded rod through a hole in the anti-climber extension, and mating a clamping nut on the threaded rod. The clamping nut may be threadably adjustable relative to the positioning nut to clamp the mounting plate against the anti-climber extension.

According to an embodiment of the present disclosure, the opening of the mounting plate may be an elongated slot, whereby a location at which the threaded rod extends through the mounting plate may be adjustable along the elongated slot. The opening of the mounting plate may have a closed peripheral boundary.

According to an embodiment of the present disclosure, the mounting plate may include a flange for engaging a distal edge of the anti-climber extension.

According to an embodiment of the present disclosure, the mounting plate may include a pair of walls arranged on opposite sides of the opening for engaging opposite flats of the positioning nut to prevent rotation of the positioning nut relative to the mounting plate.

According to an embodiment of the present disclosure, the holding member may be coupled to the threaded rod by a plurality of nuts fixed to the holding member and mated with the threaded rod. The positioning nut may be fixed to one of the plurality of nuts fixed to the holding member.

Another embodiment of the present disclosure provides an apparatus for providing a barrier between a first rail car and a second rail car connected to the first rail car by a coupling. The apparatus may comprise a first support assembly mounted on the first rail car, a first brush member supported by the first support assembly, the first brush member having a plurality of bristles, a second support assembly mounted on the second rail car, and a second brush member supported by the second support assembly, the second brush member having a plurality of bristles. The plurality of bristles of the first brush member may cooperate with the plurality of bristles of the second brush member to occupy space above the coupling.

According to an embodiment of the present disclosure, the plurality of bristles of the first brush member may overlap with the plurality of bristles of the second brush member.

According to an embodiment of the present disclosure, the first support assembly may be configured identically to the second support assembly.

According to an embodiment of the present disclosure, the first brush member may be configured identically to the second brush member.

BRIEF DESCRIPTION OF THE DRAWING VIEWS

The nature and mode of operation of the present disclosure will now be more fully described in the following detailed description taken with the accompanying drawing figures, in which.

DETAILED DESCRIPTION

Figure 1:
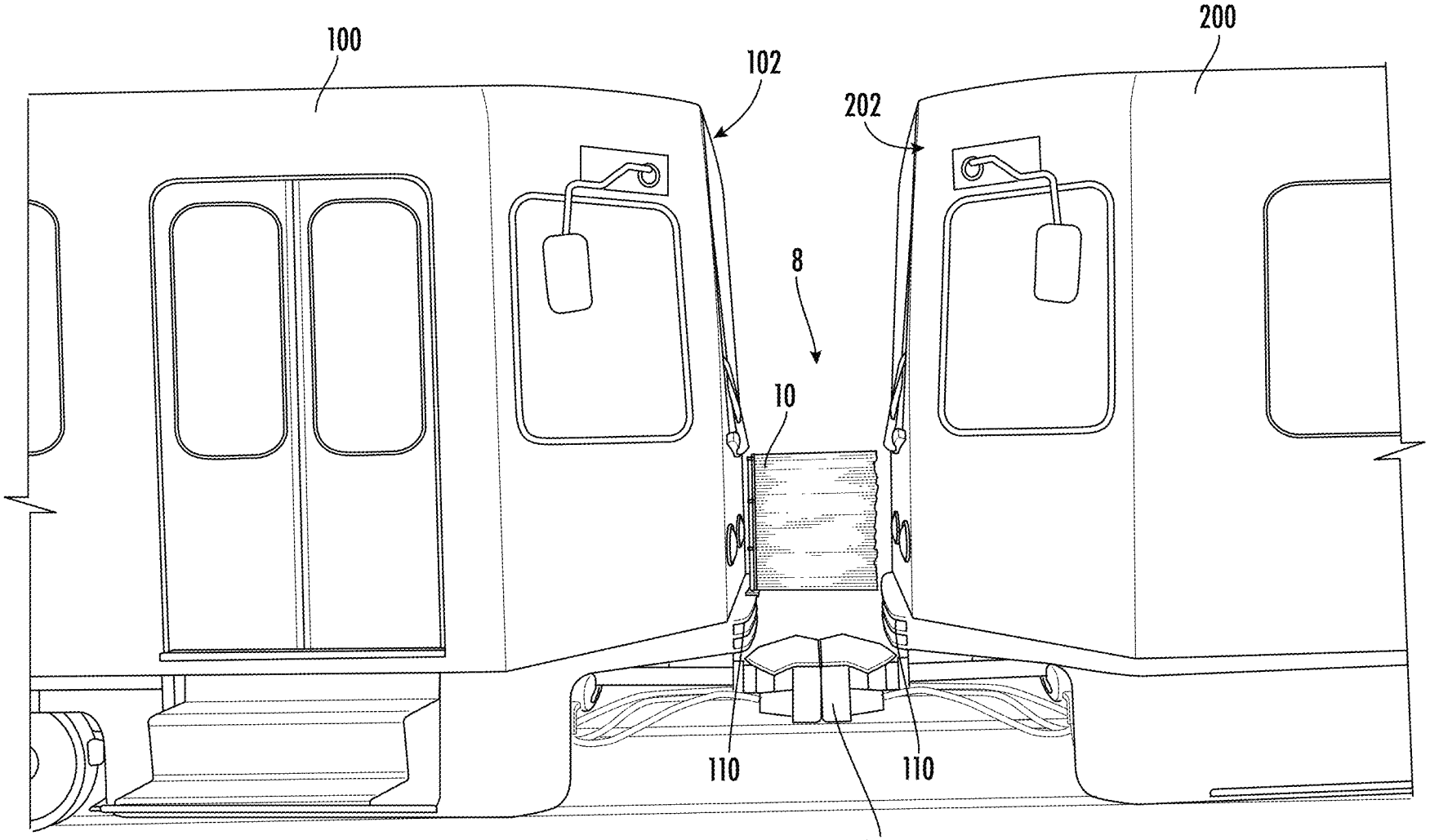
FIG. 1 is a perspective view showing a barrier apparatus according to an embodiment of the present disclosure installed on one of a pair of coupled cars of a transportation vehicle and provides a barrier substantially across to the other car of the transportation vehicle coupled cars of a transportation vehicle.

FIG. 1 depicts a barrier 8 formed between a first rail car 100 and a second rail car 200 of a transportation vehicle in accordance with an embodiment of the present disclosure. Rail cars 100, 200 are coupled to one another end-to-end by a coupling 300. The first rail car 100 may be leading or trailing relative to the second rail car 200. As may be understood, barrier 8 occupies space between rail cars 100, 200 above coupling 300 to provide a visual and physical barrier to discourage pedestrians from trying to pass between rail cars 100, 200 over coupling 300.

Barrier 8 may be provided by mounting an apparatus 10 on an end 102 of first rail car 100 and/or on an end 202 of second rail car 202 facing the end 102 of first rail car 100. Each rail car 100, 200 includes a plurality of anti-climber extensions 110 projecting longitudinally from the end 102, 202 of the rail car. Anti-climber extensions 110 may be used for mounting apparatus 10 on the rail car as described in more detail below.

FIGS. 2-7 show apparatus 10 in greater detail. Apparatus 10 may generally comprise a support assembly 20 configured to be mounted on the rail car 100 or 200, and a brush member 40 supported by the support assembly 20.

Figure 3:
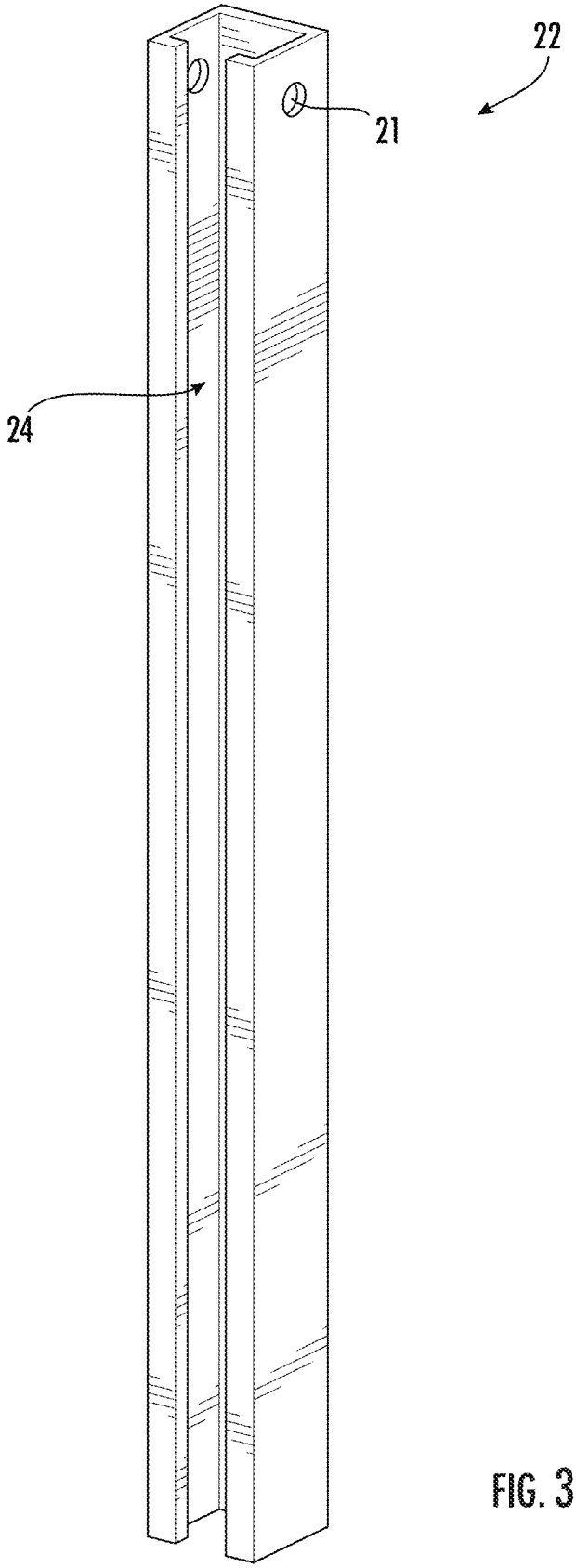
FIG. 3 is a perspective view of a holding member of the barrier apparatus according to an embodiment of the present disclosure.

Support assembly 20 may comprise a holding member 22 having an elongated channel 24. The holding member 22 is shown in FIG. 3. Support assembly may further comprise a threaded rod 26 to which holding member 22 is coupled, for example by a plurality of nuts 28 fixedly attached to holding member 22 at spaced intervals along the holding member, and the nuts 28 are threadably mated onto threaded rod 26. The nuts 28 may be hex nuts, but other types of nuts (e.g., square nuts or octagon nuts) may be used. As shown in the illustrated embodiment (e.g., FIGS. 5 and 6), nuts 28 may be fixedly attached to holding member 22 by welding. For example, a side face of each nut 28 may be welded to the holding member 22.

Support assembly 20 may also comprise a mounting plate 30 (shown in FIGS. 4A and 4B) having an opening 32 through which threaded rod 26 extends through the mounting plate 30, and a positioning nut 34 mated with threaded rod 26 and fixed relative to holding member 22. For example, positioning nut 34 may be welded to an underside of the lowermost nut 28 as seen in FIG. 5. The positioning nut 34 may be askew from the lowermost nut 28. In other words, side faces of the positioning nut 34 and the lowermost nut 28 may be non-flush. For example, side faces of the positioning nut 34 and the lowermost nut 28 may be 60 degrees relative to one another. However, if the positioning nut 34 and the lowermost nut 28 are square nuts or octagon nuts, side faces of the positioning nut 34 and the lowermost nut 28 may be flush.

Figure 2:
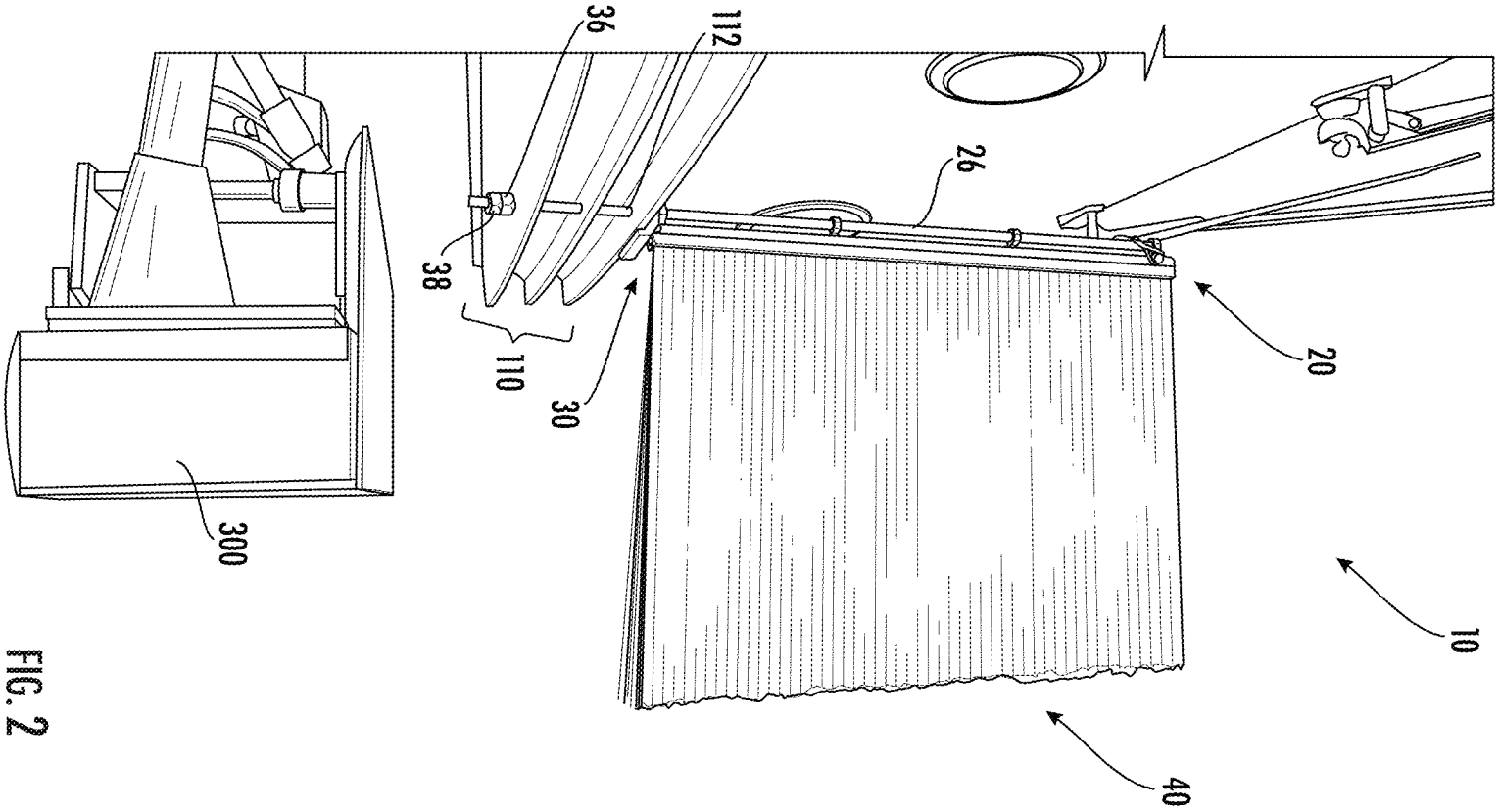
FIG. 2 is another perspective view showing the barrier apparatus mounted on a car of a transportation vehicle.

As shown in FIG. 2, support assembly 20 may be mounted on an anti-climber extension 110 of rail car 100 or 200 by setting mounting plate 30 on the anti-climber extension, extending threaded rod 26 through a hole 112 in the anti-climber extension 110, and mating a clamping nut 36 on threaded rod 26, wherein the clamping nut 36 is threadably adjustable relative to positioning nut 34 to clamp mounting plate 30 against anti-climber extension 110. In a common arrangement shown in the drawings, three vertically spaced anti-climber extensions 110 are provided on the rail cars 100, 200, and each anti-climber extension 110 includes a corresponding hole 112 at a centerline location of the rail car, such that holes 112 are aligned with one another along a vertical axis and threaded rod 26 may be arranged to extend through all the holes 112 as shown in FIG. 2. Thus, support assembly 20 may be secured to existing structure of the rails cars 100, 200 (e.g., anti-climber extensions 110 having holes 112). An additional securement nut 38 may be tightened on a lower portion of threaded rod 26 against an undersurface of the lowermost anti-climber extension 110.

Figure 4A:
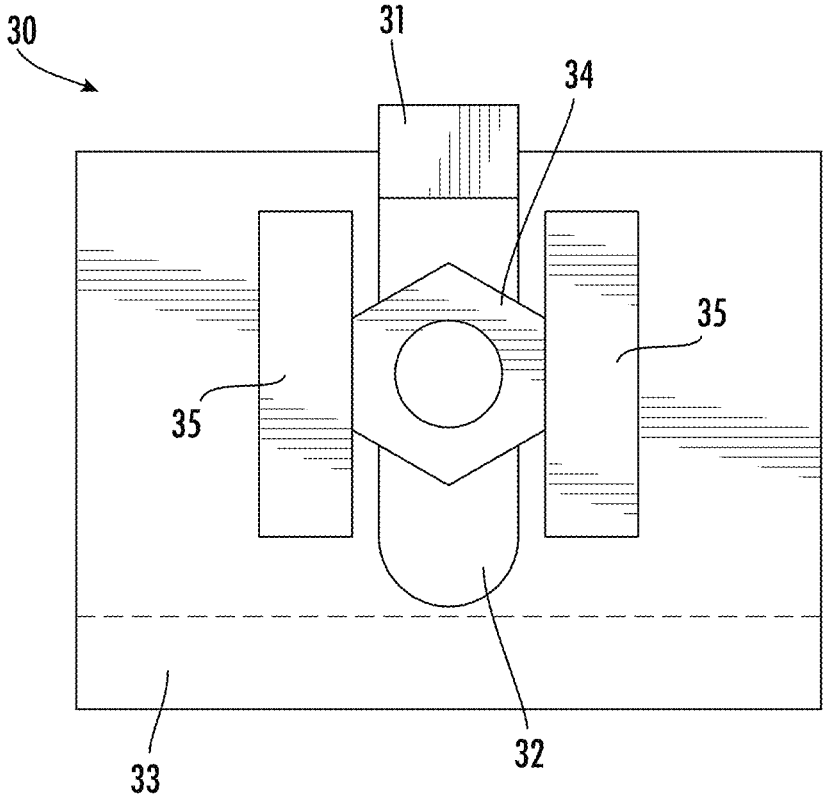
FIG. 4A is a top view of a mounting plate of the barrier apparatus according to an embodiment of the present disclosure.
Figure 5:
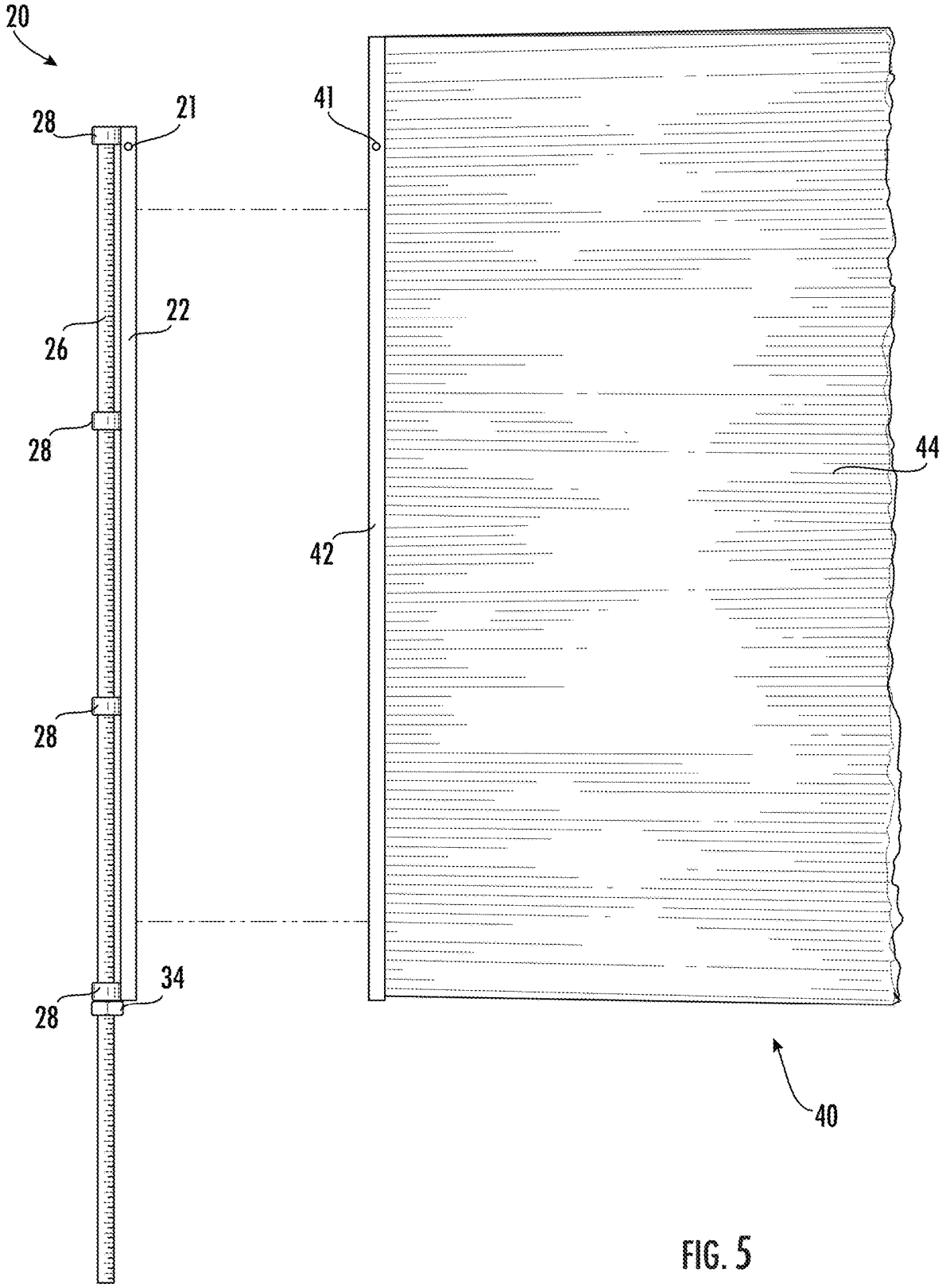
FIG. 5 is a side view of a brush member separated from the barrier apparatus according to an embodiment of the present disclosure.

As shown in FIG. 4A, the opening 32 of the mounting plate 30 may be an elongated slot. The elongated slot may have a width greater than or equal to a width of the threaded rod 26. The elongated slot may have a length extending in a direction from a proximal end to a distal end of the mounting plate 30. Thus, a location at which the threaded rod 26 extends through the mounting plate 30 may be adjustable along the length of the elongated slot. The location of the through hole 112 on the anti-climber extension 110 may vary between rail cars (e.g., by a distance from the distal edge of the anti-climber extension 110 to the center of the through hole 112), so the elongated slot may allow the mounting plate 30 to be adaptable to varying geometry.

The opening 32 may have a closed peripheral boundary. For example, the elongated slot may be closed at the proximal end and/or distal end of the mounting plate 30. Thus, the threaded rod 26 may be retained within the elongated slot when extending through the opening 32.

In an instance, the opening 32 may be formed in the mounting plate 30 being open at the proximal end. An insert 31 may be welded into the opening 32 to close the peripheral boundary at the proximal end of the mounting plate 30. The insert 31 may have a width equal to the width of the elongated slot. The insert 31 may be one or more square bars. The insert 31 may extend upward from a top surface of the mounting plate 30. The insert 31 may also protrude inward from the upward extension. Thus, the insert 31 (or inner proximal end of the closed elongated slot) may abut against the positioning nut 34 and/or threaded rod 26 to prevent the mounting plate 30 from falling off of the anti-climber extension 110 if the clamping nut 36 were to loosen during use.

Figure 4B:
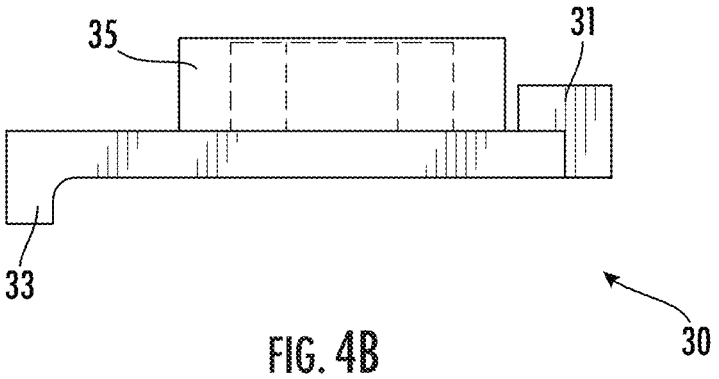
FIG. 4B is a side view of the mounting plate of FIG. 4A.

The mounting plate 30 may include a flange 33. For example, the mounting plate 30 may be comprised of an angle bar having two legs of equal width disposed at a right angle. In such instances, a top surface of the mounting plate 30 may be defined by one of the two legs of the angle bar disposed horizontally, and the flange 33 may be defined by the other leg, which extends downward from the first leg (as shown in FIG. 4B). The flange 33 may have a width that is less than the width of the top surface of the mounting plate 30, for example, by cutting the flange 33. In this way, the flange 33 may be integrally formed with the mounting plate 30. In other embodiments, the flange 33 may be a separate component secured to the mounting plate 30 (e.g., by welding). The flange 33 may extend downward from the distal end of the mounting plate 30. The flange 33 may engage a distal edge of the anti-climber extension 110. Thus, the flange 33 may align the mounting plate 30 with the anti-climber extension 110 for insertion of the threated rod 26 through the opening 32 of the threaded rod 26 and the corresponding hole 112 of the anti-climber extension 110.

The mounting plate 30 may include a pair of walls 35 extending from a top surface of the mounting plate and arranged on opposite sides of the opening 32. The pair of walls 35 may be formed from a square bar. The pair of walls 35 may have a height that is less than or equal to a thickness of the positioning nut 34. The pair of walls 35 may have a length that is greater than or equal to the length of the opening 32. A distance between the pair of walls 35 may be equal to a width between opposite flats of the positioning nut 34. Thus, the positioning nut 34 may be disposed between the pair of walls 35 such that the pair of walls 35 prevent rotation of the positioning nut 34 relative to the mounting plate 30.

It can be understood that the inward faces of the pair of walls 35 are 90 degrees relative to the end face of the holding member 22. Thus, if the positioning nut 34 and the plurality of nuts 28 are hex nuts, the positioning nut 34 may be askew from the lowermost nut 28 by 60 degrees, such that the opposite flats of the positioning nut 34 are flush with, and disposed between, the inward faces of the pair of walls 35.

As shown in FIG. 5, the brush member 40 may comprise a spine 42 and a plurality of bristles 44 extending from the spine 42. The spine 42 may be slidably received in the elongated channel 24 of the holding member 22. For example, as shown in FIG. 3, the elongated channel 24 may have a "C" shape, where the spine 42 is slidably received in the elongated channel 24 and the plurality of bristles 44 extend out from the elongated channel 24. The plurality of bristles 44 may be made of plastic.

Figure 6:
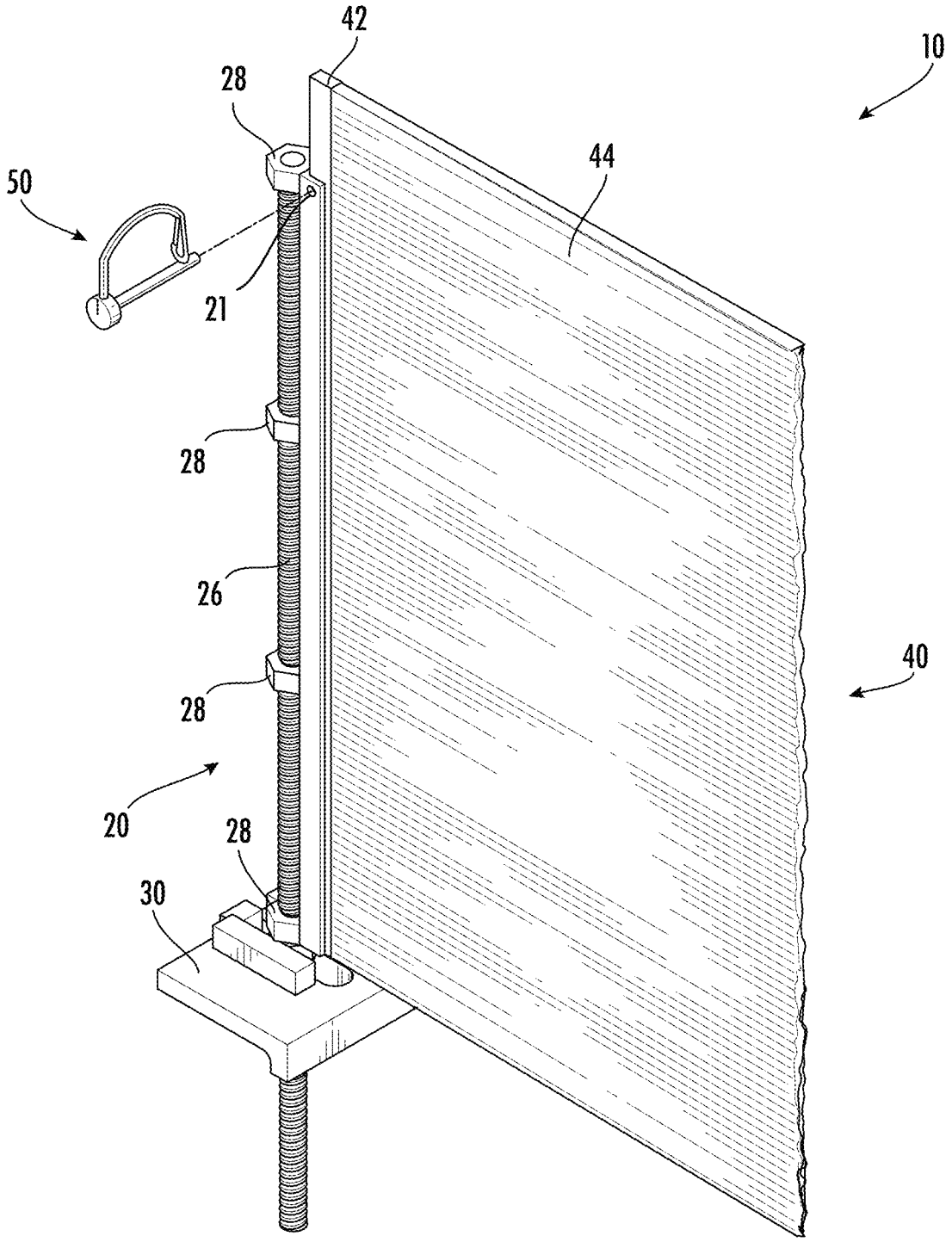
FIG. 6 is another perspective view of the barrier apparatus.

As shown in FIG. 6, the apparatus 10 may comprise a retainer pin 50. The holding member 22 and the spine 42 may include respective holes to slidably receive the retainer pin 50. For example, the holding member 22 may include an alignment hole 21 and the spine 42 may include a spine hole 41, as shown in FIG. 5. The alignment hole 21 and the spine hole 41 may align when the spine 42 is received by the holding member 22. When the retainer pin 50 is inserted into the alignment hole 21 and the spine hole 41, the retainer pin 50 may prevent the spine 42 from sliding within the holding member 22. In addition, the retainer pin 50 may be removed from the alignment hole 21 and the spine hole 41 to allow removal of the spine 42 from the holding member 22. Thus, the retainer pin 50 may provide simple assembly of the brush member 40 and the support assembly 20, and may allow simple replacement of the brush assembly 40.

Figure 7:
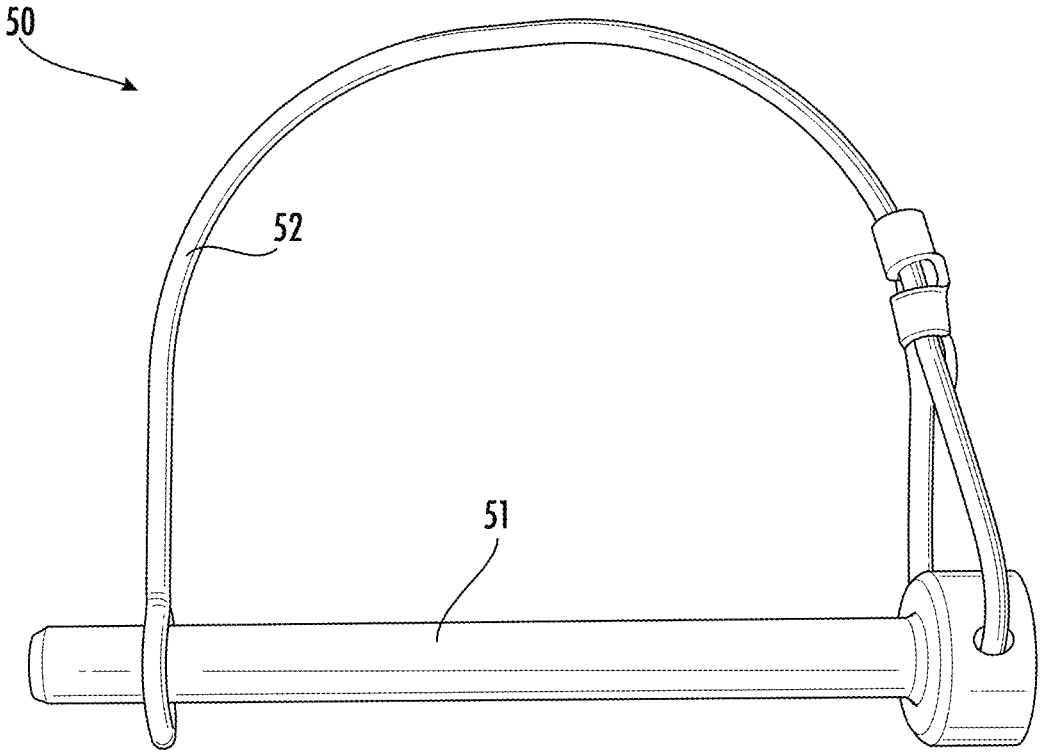
FIG. 7 is a perspective view of a retainer pin of the barrier apparatus according to an embodiment of the present disclosure.

As shown in FIG. 7, the retainer pin 50 may include a pin body 51 and a clip 52 which releasably retains the retainer pin 50 in the alignment hole 21 and the spine hole 41. For example the clip 52 may be a tether rotatably connected to the head of the pin body 51. A free end of the tether may be connectable to the shaft of the pin body 51 extending out of the alignment hole 21 on the opposite side of the holding member 22. For example, the free end of the tether may be a loop which receives the shaft of the pin body 51. In another embodiment, the pin body 51 may be a clevis pin and the clip 52 may be a cotter pin. The cotter pin may be inserted into a hole in the shaft of the pin body 51 on the opposite side of the holding member 50.

When the spine 42 of the brush member 40 is received by the holding member 22 of the support assembly 20, the plurality of bristles 44 may occupy a space above the coupling 300 when the support assembly 20 is mounted on the first rail car 100 to define the barrier 8.

According to an embodiment of the present disclosure, the apparatus 10 may comprise commonly-available stock components. For example, the apparatus 10 may comprise the following components: (1) a ⅝"-11 threaded rod, 37" long; (2) seven ⅝"-11 hex nuts; (3) a ⅝" washer; (4) a ⅝" lock washer; (5) a 28" long C-channel bar; (6) a 30" long brush; (7) a mounting plate comprising (a) a 3"×3"×¼" angle bar, 4" long and having a ¾" slot; (b) two ½"×½"×1¾" square bars; and a ½"×½"×¾" square bar; and (8) 3" long retainer pin. When assembled, the threaded rod may extend about 9" below the mounting plate, to accommodate securement to anti-climber extensions having varying thicknesses.

According to an embodiment of the present disclosure, the barrier 8 may comprise a single apparatus 10 secured to the first rail car 100 or the second rail car 200. As shown in FIG. 1, the plurality of bristles 44 may extend from the first rail car 100 to the second rail car 200. In some embodiments, the plurality of bristles 44 may extend a portion of the distance from the first rail car 100 to the second rail car 200. For example, the plurality of bristles 44 may extend a distance that is greater than or equal to half of the distance from the first rail car 100 to the second rail car 200.

Figure 8:
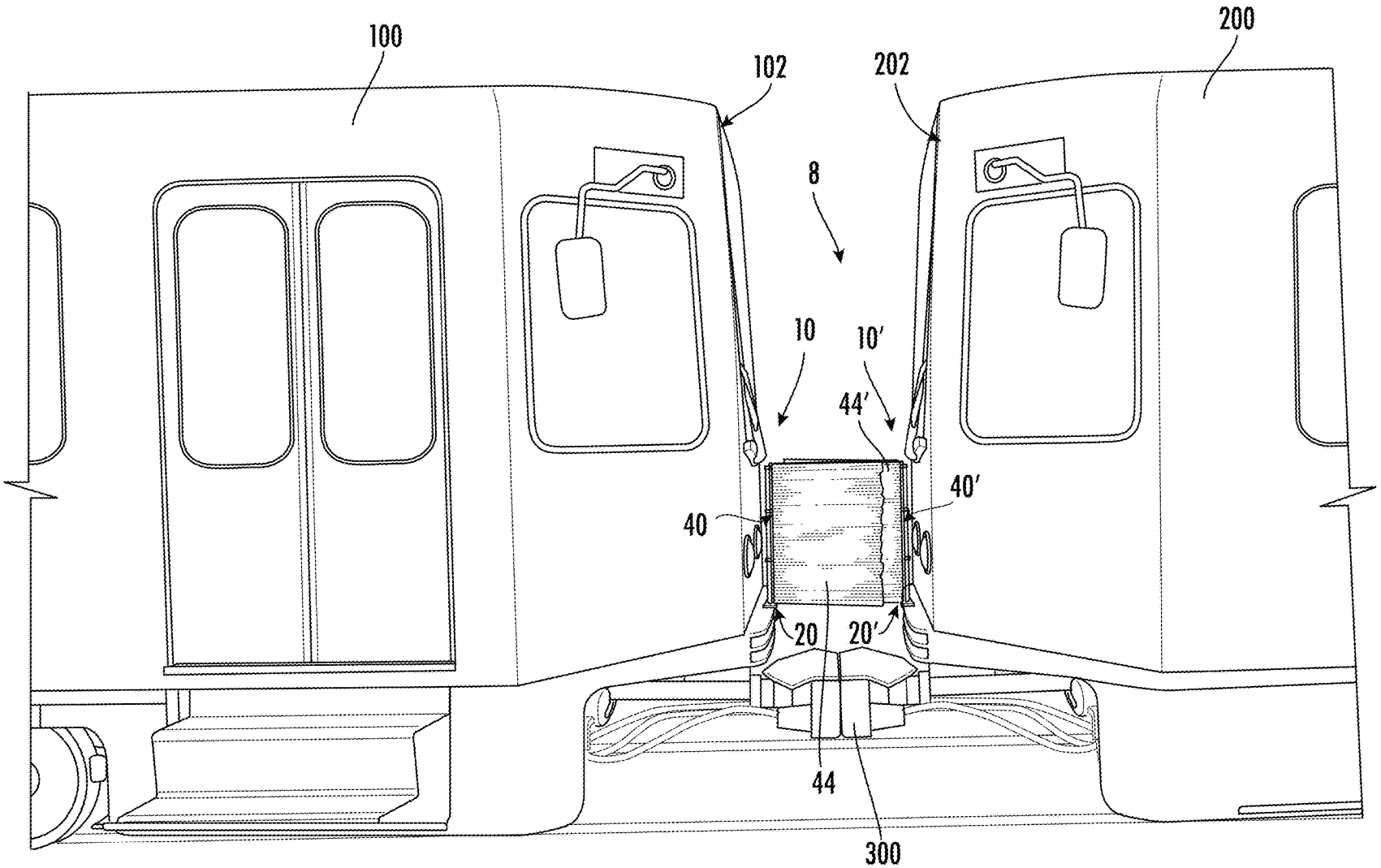
FIG. 8 is a perspective view showing a barrier apparatus according to an alternative embodiment of the present disclosure, wherein the barrier apparatus is installed on two coupled cars of a transportation vehicle.

According to an embodiment of the present disclosure shown in FIG. 8, the barrier 8 may comprise a pair of apparatuses 10 and 10' secured to the first rail car 100 and the second rail car 200, respectively.

The first apparatus 10 may comprise a first support assembly 20 mounted on the first rail car 100, and a first brush member 40 supported by the first support assembly 20. The first brush member 40 may have a plurality of bristles 44.

The second apparatus 10' may comprise a second support assembly 20' mounted on the second rail car 200, and a second brush member 40' supported by the second support assembly 20'. The second brush member 40' may have a plurality of bristles 44'.

As shown in FIG. 8, the plurality of bristles of the first brush member 44 cooperate with the plurality of bristles of the second brush member 44' to occupy space above the coupling 300. For example, the plurality of bristles of the first brush member 44 may overlap with the plurality of bristles of the second brush member 44'. In an instance, the plurality of bristles of the first brush member 44 may be intertwined with the plurality of bristles of the second brush member 44'.

The first support assembly 10 may be configured identically to the second support assembly 10', in accordance with the support assembly 10 described above.

The first brush member 40 may be configured identically to the second brush member 40', in accordance with the brush member 40 described above.

The barrier 8 may provide a visual barrier and a physical barrier to deter patrons from passing between rail cars. With the barrier 8 of the present disclosure, several improvements may be provided compared to prior art barrier systems. For example, the barrier 8 may be mechanically simple, may have low cost to manufacture and maintain, may be easy to mount on cars of a vehicle, may be robust in freezing temperatures and/or inclement weather, and may reduce risk of a person becoming entangled in the barrier system (e.g., clothing caught on a portion of the barrier system) or otherwise trapped by the barrier system between coupled cars.

While the disclosure describes various exemplary embodiments, the detailed description is not intended to limit the scope of the disclosure to the particular forms set forth. The disclosure is intended to cover such alternatives, modifications and equivalents of the described embodiment as may be apparent to one of ordinary skill in the art.

What is claimed is:

1. An apparatus for providing a barrier between a first rail car and a second rail car connected to the first rail car by a coupling, the apparatus comprising:

a support assembly configured to be mounted on the first rail car, the support assembly including a holding member; and a brush member having a spine and a plurality of bristles extending from the spine;

wherein the spine of the brush member is received by the holding member of the support assembly such that the plurality of bristles occupy space above the coupling when the support assembly is mounted on the first rail car;

wherein the support assembly further includes a threaded rod to which the holding member is coupled, a mounting plate having an opening through which the threaded rod extends through the mounting plate, and a positioning nut mated with the threaded rod and fixed relative to the holding member, wherein the support assembly is mountable on an anti-climber extension of the first rail car by setting the mounting plate on the anti-climber extension, extending the threaded rod through a hole in the anti-climber extension, and mating a clamping nut on the threaded rod, wherein the clamping nut is threadably adjustable relative to the positioning nut to clamp the mounting plate against the anti-climber extension.

2. The apparatus according to claim 1, wherein the holding member includes a channel, and the spine is slidably received by the channel.

3. The apparatus according to claim 2, further comprising a retainer pin, wherein the holding member and the spine include respective holes aligned with one another when the spine is received by the holding member, and the retainer pin is slidably insertable into the aligned holes to releasably retain the spine in the channel of the holding member.

4. The apparatus according to claim 1, wherein the opening of the mounting plate is an elongated slot, whereby a location at which the threaded rod extends through the mounting plate is adjustable along the elongated slot.

5. The apparatus according to claim 4, wherein the opening of the mounting plate has a closed peripheral boundary.

6. The apparatus according to claim 5, wherein the mounting plate includes a flange for engaging a distal edge of the anti-climber extension.

7. The apparatus according to claim 1, wherein the mounting plate includes a pair of walls arranged on opposite sides of the opening for engaging opposite flats of the positioning nut to prevent rotation of the positioning nut relative to the mounting plate.

8. The apparatus according to claim 1, wherein the holding member is coupled to the threaded rod by a plurality of nuts fixed to the holding member and mated with the threaded rod.

9. The apparatus according to claim 8, wherein the positioning nut is fixed to one of the plurality of nuts fixed to the holding member.

10. An apparatus for providing a barrier between a first rail car and a second rail car connected to the first rail car by a coupling, the apparatus comprising:

a first support assembly mounted on the first rail car;

a first brush member supported by the first support assembly, the first brush member having a plurality of bristles;

a second support assembly mounted on the second rail car; and a second brush member supported by the second support assembly, the second brush member having a plurality of bristles;

wherein the plurality of bristles of the first brush member cooperate with the plurality of bristles of the second brush member to occupy space above the coupling.

11. The apparatus according to claim 10, wherein the plurality of bristles of the first brush member overlap with the plurality of bristles of the second brush member.

12. The apparatus according to claim 10, wherein the first support assembly is configured identically to the second support assembly.

13. The apparatus according to claim 12, wherein the first brush member is configured identically to the second brush member.

* * * * *